United States Patent [19]

Metzler

[11] Patent Number: 4,851,083

[45] Date of Patent: Jul. 25, 1989

[54] HEADBOX SLICE MEASUREMENT GAUGE

[75] Inventor: Steven P. Metzler, Covington, Va.

[73] Assignee: Westvaco Corporation, New York, N.Y.

[21] Appl. No.: 295,570

[22] Filed: Jan. 11, 1989

[51] Int. Cl.[4] ..... D21F 7/00; D21F 7/06

[52] U.S. Cl. ..... 162/263; 33/626; 162/198; 162/336

[58] Field of Search ..... 162/198, 263, 344, 336, 162/259; 33/170, 626, 655

[56] References Cited

U.S. PATENT DOCUMENTS

| | | | |
|---|---|---|---|
| 3,018,557 | 1/1962 | Nakata | 33/170 |
| 3,575,799 | 4/1971 | Gedemer et al. | 162/263 |
| 3,727,318 | 4/1973 | Meier | 33/170 |
| 3,813,285 | 5/1974 | Shelor | 162/263 |
| 3,994,773 | 11/1976 | Wolf et al. | 162/263 |
| 4,517,055 | 5/1985 | Dove | 162/263 |
| 4,539,073 | 9/1985 | Andersson | 162/198 |

*Primary Examiner*—Karen Hastings

*Attorney, Agent, or Firm*—W. A. Marcontell; R. L. Schmalz

[57] ABSTRACT

Complete definition of a papermachine headbox slice opening requires the measurement of three interdependent dimensions including (1) the projection distance of the slice lip edge below the slice beam, (2) the projection distance of the slice apron edge beyond the plane of the slice lip edge and (3) the slice opening distance between the slice lip edge and the upper face plane of the slice apron. A single gauging tool is provided for measuring all three headbox slice dimensions.

2 Claims, 2 Drawing Sheets

HEADBOX SLICE MEASUREMENT GAUGE

BACKGROUND OF THE INVENTION

1. Field of the Invention

The present invention relates to fourdrinier papermaking by which a continuous web is formed from a jet of fibrous slurry flowing through a slice opening in a headbox. More particularly, the present invention relates to a gauge or tool for measuring the three interdependent dimensions of a papermachine headbox slice opening.

2. Description of the Prior Art

In the continuous, fourdrinier method of manufacturing paper, a slurry of aqueously suspended fiber jets from the elongated slice opening of a headbox onto a traveling drainage screen. The fiber constituency of the slurry is retained on the screen surface to form an accumulated mat or web while the aqueous vehicle drains through the screen pores.

One of the more highly sought quality characteristics of paper made by this method is a uniform cross-directional basis weight: i.e. a uniform weight of dry fiber per unit area across the width of web so formed. A significant basis weight profile control parameter is the headbox slice profile. This profile is essentially defined by three, interrelated dimensions: (1) the slice opening, (2) the slice lip projection and (3) the apron length.

The slice apron is that structural component of a headbox serving as the lower support element for the slurry as it flows across the headbox slice opening. The slice lip is that structural component of a headbox having a very thin longitudinal lower edge which defines or delineates between the headbox interior and exterior. A headbox slice beam is the front wall of the headbox to which the slice lip is structurally secured albeit accommodation is given to adjustment of the slice lip in the vertical plane by means of numerous, uniformly spaced slice adjusting rods or screws.

From these components, the slice opening is that distance between the lower edge of the slice lip to the upper surface plane of the slice apron. The slice lip projection is that distance between the lower edge of the slice beam and the lower edge of the slice lip. The slice apron length is that distance between the terminal end of the slice apron and the vertical plane of the slice lip.

Interdependence of these slice dimensions arises from the complex structure of the headbox slice beam and automatic control over the beam and lip profiles. There are two dominant stress sources upon the beam. Thermal stress due to temperature differences between the slurry and the ambient atmosphere surrounding the headbox may warp or bow the beam in a large, shallow arc from deckle to deckle. The resulting geometric consequence of these stresses on the slice profile normally is not planar-parallel with the slice apron plane, i.e. the bow causes a slice lip having a uniform lip projection to yield a slice opening in the slice center different from that at the deckle edges. Another source of stress on the headbox beam having slice opening profile consequences is the hydraulic head of the slurry therewithin. If uncorrected, a basis weight gradient in the web may result.

Correction of such a beam bow usually takes the form of automatic slice lip adjustment by which the electronically scanned basis weight profile is translated to motorized rotation of the slice lip adjusting rods. If properly calibrated, this slice lip adjustment will level the slice opening relative to the apron notwithstanding the beam bow. Simultaneously, profiled differentials will arise in the lip projection and apron length dimensions.

To a certain degree, such profiled differentials in the slice lip and apron length dimensions are acceptable. When the acceptable limits are exceeded, however, other control forces must be brought to bear on the slice beam itself. For these reasons, it is essential that the slice lip be correctly calibrated relative to the slice beam and slice apron. Such correct calibration requires that the three slice lip dimensions hereto described begin from uniform or at least known settings when the headbox is empty and at a stable ambient temperature. This requires a very careful, consistent, and extremely precise manual measurement of the dimensions at approximately 30 locations across the slice width: many of which must be made from an awkward position.

It is, therefore, an object of the present invention to provide a light and easily manipulated gauge that is adapted for measuring all three of the critical slice opening dimensions.

SUMMARY OF THE INVENTION

This and other objects of the invention, as will be apparent from the following description, are served by a substantially rectangular base plate having two parallel reference fences and dial micrometers. One reference fence is on the bottom of the plate for following the terminal end of the slice apron. The other reference fence has a beveled face for planar alignment with the underside of the headbox beam. Both micrometers are post mounted on an axis perpendicular to the base plate at one end thereof. One micrometer is of the plunger type that is mounted with the plunger axis perpendicular to the fence plane. The other micrometer is of the swinging stylus type; also mounted with the stylus swing plane perpendicular to the fence plane.

The slice apron length and slice opening dimensions are taken across the entire slice width by holding the bottom fence firmly against the terminal end of the slice apron and adjusting the micrometers to convenient reference position against the slice lip engaging the outer vertical face and lower edge, respectively. Relative dimensional changes along the slice width are reported on the micrometer dials as the gauge is manually slid along the apron edge length. These dimensional measurements are usually noted relative to the most proximate adjusting rod position.

Slice lip projection dimensions are also measured with a sliding motion as the gauge is held with the upper, beveled fence face flat against the beam face and pulled into contact with slice lip backside face. Relative dimensional changes are read from the swinging stylus micrometer which engages the slice lip lower edge.

BRIEF DESCRIPTION OF THE DRAWING

Relative to the drawing wherein like reference characters designate like or similar elements throughout the several figures of the drawing.

DESCRIPTION OF THE PREFERRED EMBODIMENT

Figure 1:
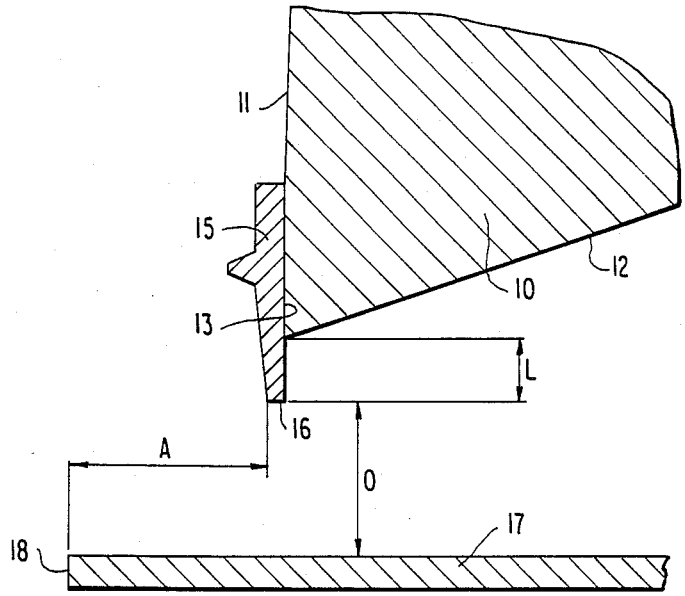
FIG. 1 is a sectional schematic of a papermachine headbox slice region.

To facilitate subsequent explanation of the invention utility and novelty; reference is made to FIG. 1 for definitions of relevant structures and dimensions. Therein, a headbox slice beam 10 is represented as having a front wall 11 and a back wall 12. Firmly clamped against the front wall 11 is a profile bar 15 having a lip edge 16. Opposite from the slice edge 16 and across the slice opening O is a horizonal slice apron 17 having a terminal edge 18. The projection distance A of the apron edge 18 beyond the vertical plane of the lip edge 16 is the apron length.

The slice lip edge 16 also projects downwardly toward the apron 17 below the intersection of the beam 10 back wall plane 12 and the vertical plane 13 of the profile bar 15 backside. This projection is designated the slice lip projection L.

Figure 2:
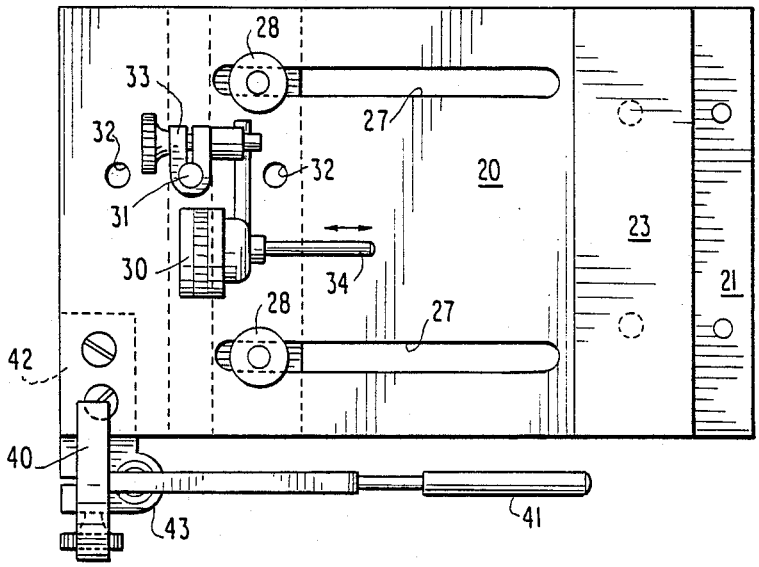
FIG. 2 is a plan view of the invention.
Figure 3:
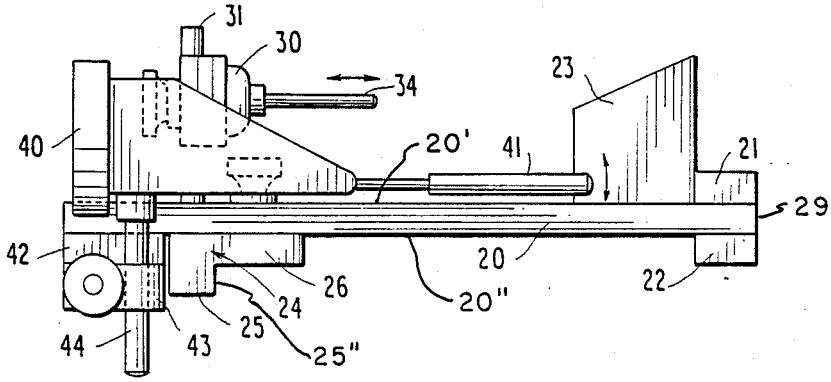
FIG. 3 is a side elevation of the invention.
Figure 4:
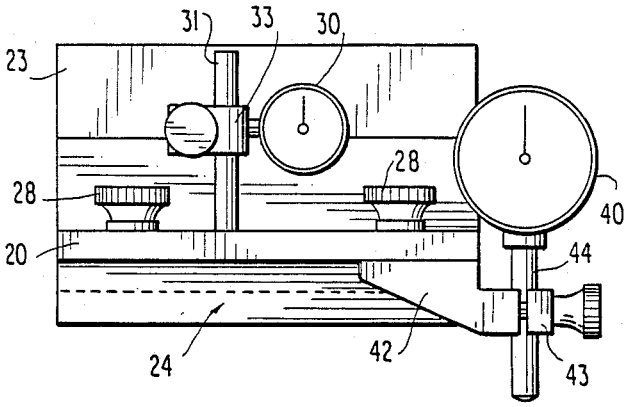
FIG. 4 is an end elevation of the invention.

Although the absolute values of the dimensions A, O and L are important to the papermaker, it is the minute variations in a predetermined dimensional combination that concern him most frequently. For calibration purposes, therefore, it is the relative variations in these dimensions that must be identified respective to cross-machine position stations. The need to quickly and accurately identify these variations and their corresponding coss-machine location is served by the gauge shown in detail by FIGS. 2, 3 and 4.

Structurally, the present gauge comprises a generally rectangular base plate 20 having an upper face 20' and a lower face 20''. This base plate is fabricated of brass, aluminum or other soft metal to protect the finish of the headbox lip structure. Rigidly secured to the base plate 20, along a reference edge 29 thereof are end bars 21 and 22. Topside end bar 21 is an end boundary fence for the beveled face fence 23. Preferably, the topside bar 21 is of soft metal like the base plate 20 while the beveled fence 23 is of a relatively soft, low friction material such as Teflon (polytetrafluoroethylene) or nylon.

The bottom side end bar 22 is a balancing slide shoe surface corresponding to the shoe surface portion 26 of the apron fence block 24. Fence step portion 25 of the fence block projects below the horizonal face of the shoe surface 26 to provide a fence edge 25'' which abuts the apron terminal edge 18. End bar 22 and fence block 24 are both of relatively soft, low friction material such as Teflon or nylon to prevent scratching of the headbox slice elements and facilitate sliding movement of the gauge along the apron 17 surface.

For flexibility of use, the fence block 24 is positionally adjustable along base plate slots 27. Thimble nuts 28 threaded onto machine screws passing through the fence block 24 clamp the block in a desired position against the baseplate.

To support the plunger micrometer 30, a post 31 is provided for threaded insert into one of several aligned sockets 32 in the base plate whereby the post 31 axis is perpendicular to the base plate plane. A post clamp 33 secures the micrometer to the post 31. The micrometer 30 face dial is actuated by reciprocal displacement of the plunger element 34.

Swing arm micrometer 40 is actuated by arcuate displacement of the wand 41. Positionment of the swing arm micrometer is alongside the base plate from a lateral bracket 42 which includes an integral post clamp 43. The micrometer supporting post 44 align with its axis perpendicular to the base plate 20 plane.

Figure 5:
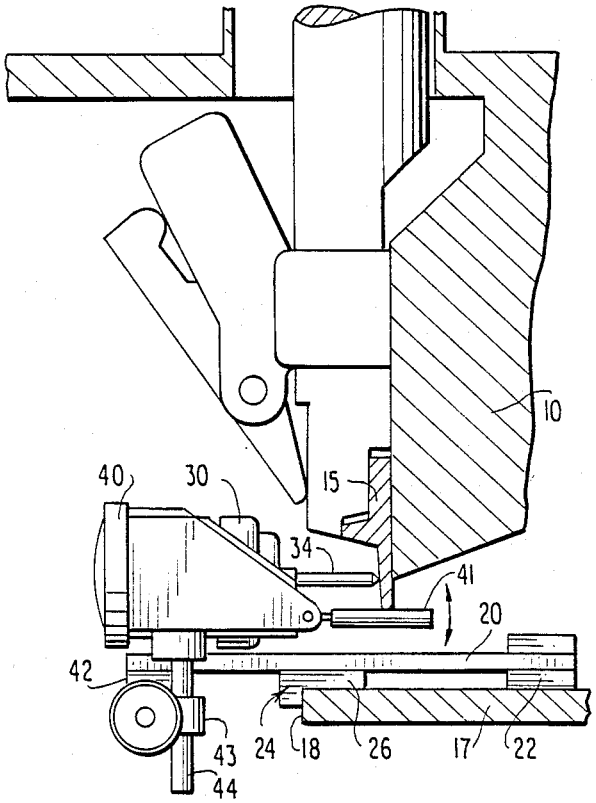
FIG. 5 is a schematic of the invention as used to measure slice opening and apron length.

To measure variations in the apron length A and the slice opening O, the present gauge is adjusted and positioned as shown by FIG. 5 with the lower faces of shoe surfaces 22 and 26 firmly against the upper face of apron 17. Simultaneously, the stepped edge of fence block 24 firmly engages the terminal edge 18 of the apron. In this position, the micrometer support post 44 is axially aligned in the clamp 43 for substantial arcuate displacement of the swinging wand 41. The micrometer dial face is then rotated for reference alignment with the indicator needle.

Similarly, an appropriate socket 32 is selected for the plunger micrometer mounting post 31 to provide an initial displacement of the plunger 34 against the slice lip face of profile bar 15. As before, the dial face is rotated for needle reference alignment.

In this configuration, the gauge is manually slid along the apron edge with notation given to the variations in apron length projection, measured by plunger micrometer 30, and slice opening, measured by swing arm micrometer 40. These variations are correlated to a cross-machine location address for subjective evaluation.

Figure 6:
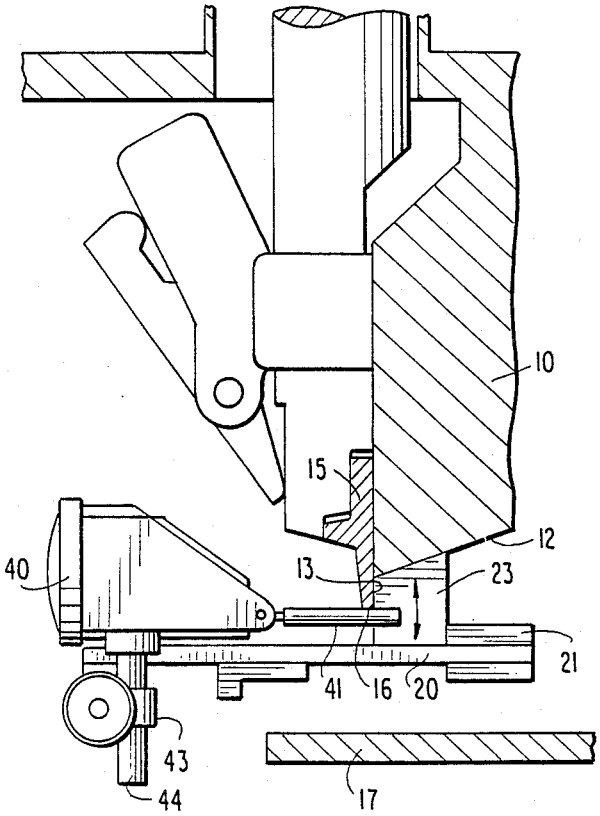
FIG. 6 is a schematic of the invention as used to measure slice lip projection.

Additive to that subjective evaluation are the slice lip projection variations as measured in the manner of FIG. 6. For this purpose the gauge is held upwardly with beveled face fence 23 firmly against the slice beam back wall 12 and the profile bar backside 13. The mounting post height of swing arm micrometer 40 is adjusted for mid-range displacement of the wand 41 against the lip edge 16 and the dial face rotated for needle reference alignment.

In this configuration, the gauge is slid along the length of profile bar and the dimensional variations reported by the micrometer 40 are correlated to the corresponding crossmachine location address.

Having fully described my invention.

I claim:

1. A papermachine headbox slice dimension gauge comprising a planar base plate having an upper face, a lower face and a reference edge, slide shoe means of low friction material secured to said lower face, parallel with said reference edge and adjacent thereto, first fence means of low friction material adjustably clamped to said lower face having a fence edge parallel with said reference edge, second fence means secured to said upper face, parallel with said reference edge and proximate thereof, said second fence having a vertical plane perpendicular to said base plate plane and parallel with said reference edge, said vertical plane being intersected by a headbox backwall engaging surface plane set at an angle to said base plate plane which corresponds to an angle a papermachine headbox backwall departs from the horizontal, first micrometer means having an axially reciprocating plunger element secured to said base plate on the upper face thereof with a reciprocation axis of said plunger element aligned parallel to said base plate plane and perpendicular to said reference edge, second micrometer means having an arcuately swinging element secured to said base plate on the upper face side thereof with an arcuate swing plane of said swinging element aligned perpendicular to said base plate plane and to said reference edge; the gauge being structured and arranged so that said first micrometer reciprocating plunger senses dimensional variations of a headbox slice lip plane relative to a respective slice apron edge plane when said first fence means is juxtaposed against a slice apron edge and said second micrometer swinging element senses dimensional variations of a headbox slice lip edge relative to a respective slice apron plane when said first fence means is juxtaposed against said apron edge and said slide shoe means juxtaposes a surface of said slice apron.

2. A papermachine headbox slice dimension gauge as described by claim 1 wherein the gauge is structured and arranged so that said second micrometer swinging element senses dimensional variations of said headbox slice lip edge relative to a respective headbox backwall when said second fence means is positioned with said vertical plane juxtaposed to a back surface of said slice lip and said backwall engaging surface plane is juxtaposed to said backwall.

* * * * *